US007359523B2

(12) United States Patent
Sims

(10) Patent No.: US 7,359,523 B2
(45) Date of Patent: Apr. 15, 2008

(54) FLUIDIC ACOUSTIC TRANSDUCER

(75) Inventor: Tyler Sims, Knoxville, TN (US)

(73) Assignee: Avago Technologies Fiber IP Pte Ltd, Singapore (SG)

( * ) Notice: Subject to any disclaimer, the term of this patent is extended or adjusted under 35 U.S.C. 154(b) by 1074 days.

(21) Appl. No.: 10/462,988

(22) Filed: Jun. 17, 2003

(65) Prior Publication Data

US 2004/0258258 A1 Dec. 23, 2004

(51) Int. Cl.
*H04R 3/00* (2006.01)

(52) U.S. Cl. ..... 381/111; 381/150; 381/172; 385/12; 385/15

(58) Field of Classification Search ..... 381/166, 381/111, 165, 150, 172; 385/12, 15
See application file for complete search history.

(56) References Cited

U.S. PATENT DOCUMENTS 3,992,593 A * 11/1976 Heine ..... 369/18
4,952,797 A 8/1990 Spillman, Jr.
5,757,987 A 5/1998 Presby
5,784,471 A 7/1998 Bebenroth
5,944,687 A 8/1999 Benett et al.
6,195,478 B1 2/2001 Fouquet
6,320,994 B1 11/2001 Donald et al.
6,324,316 B1 11/2001 Fouquet et al.
6,487,333 B2 11/2002 Fouquet et al.
6,493,482 B1 * 12/2002 Al-hemyari et al. ..... 385/19

FOREIGN PATENT DOCUMENTS

JP 04-269632 * 9/1992

* cited by examiner

*Primary Examiner*—Vivian Chin
*Assistant Examiner*—Con P. Tran

(57) ABSTRACT

Sound signals are detected. Light signals are generated that pass through a membrane of a bubble within a trench. The sound signals cause deformations within the membrane of the bubble. The light signals are detected after the light signals have passed through the membrane. The sound signals are reconstructed from the light signals detected by the optical detector.

20 Claims, 9 Drawing Sheets

FLUIDIC ACOUSTIC TRANSDUCER

BACKGROUND

The present invention concerns transducers and pertains particularly to a fluidic acoustic transducer.

Acoustic transducers are used to translate sound into electrical signals. In many fields in which transducers are used, such as in the field of communications, it is desirable to shrink the physical size of transducers while maintaining high sensitivity in selected sound ranges.

SUMMARY OF THE INVENTION

In accordance with the preferred embodiment, sound signals are detected. Light signals are generated that pass through a membrane of a bubble within a trench. The sound signals cause deformations within the membrane of the bubble. The light signals are detected after the light signals have passed through the membrane. The sound signals are reconstructed from the light signals detected by the optical detector.

DESCRIPTION OF THE PREFERRED EMBODIMENT

Figure 1:
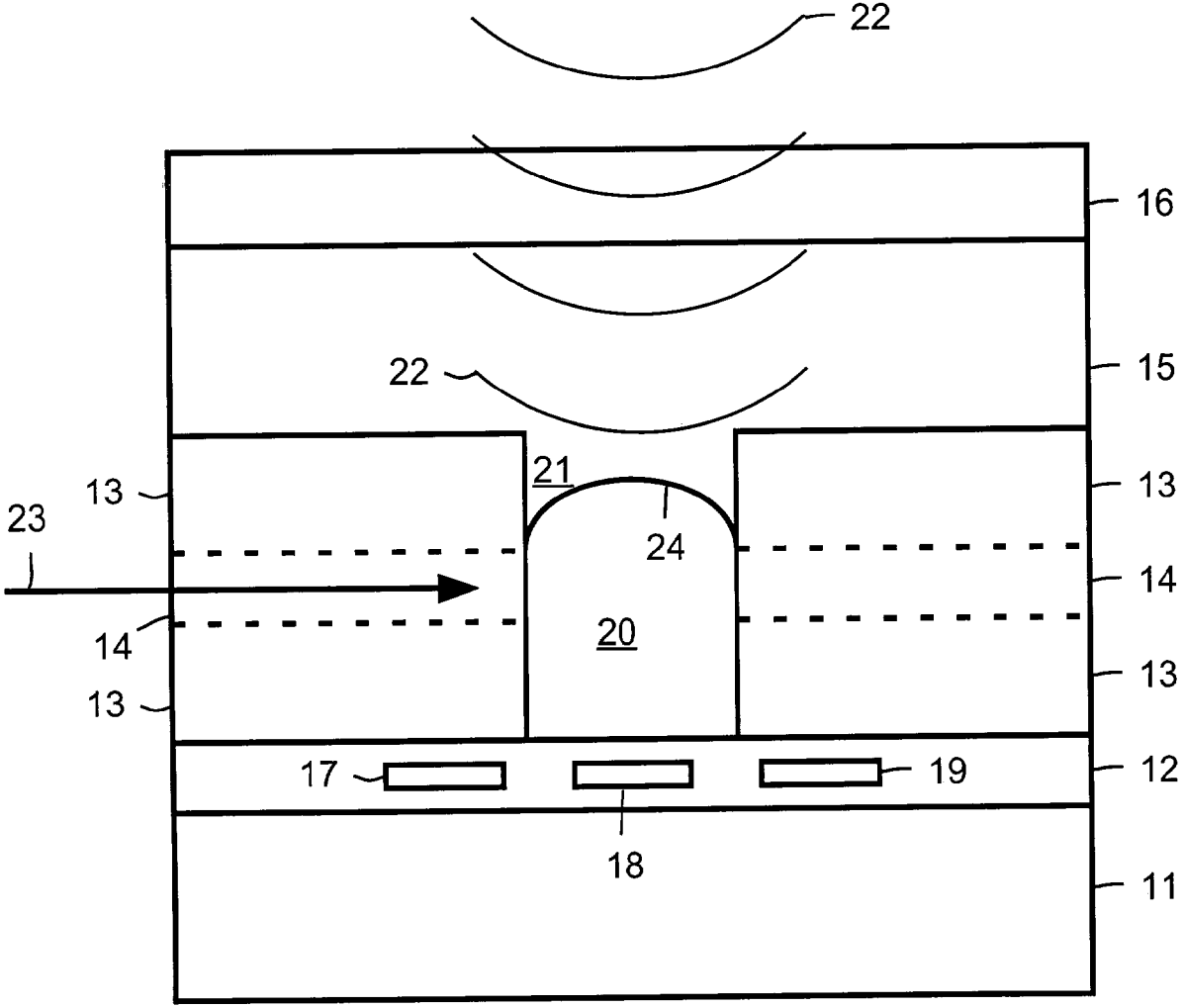
FIG. 1 shows a fluidic acoustic transducer in which sidewall detection is used in accordance with a preferred embodiment of the present invention.

FIG. 1 shows a fluidic acoustic transducer in which sidewall detection is used. A substrate 11 is, for example, composed of silicon. Alternatively, substrate 11 is another material such as silicon dioxide (SiO2), Si3N4, SiC, silicon on sapphire (SOS), silicon on insulator (SOI), silicon on another type of material, quartz, etc.

On top of substrate 11, a layer 12 of SiO2 material is formed. Within layer 12 of SiO2 material a heater array is formed. The heater array is arranged such that each transducer has either two side heaters or one central heater and two side heaters. Shown in FIG. 1 are side heater 17, side heater 19 and central heater 18.

Layer 12 is a bondable top layer. For example, the top layer is composed of Teos, silica, or fluoropolymers. On top of layer 12, is placed a planar waveguide that includes cladding 13 within which a core 14 runs. The substrates can be bonded by one of several methods that include anodic bonding, fusion bonding, or soldering. Alternatively, spin on or deposited films (fluoropolymers, teos, etc) can be substituted for a bonded layer.

A trench 21 is formed, for example, using a wet etch, a dry etch, laser, or photolithographic exposure. Trench 21 is representative of multiple trenches that can be formed on a single substrate, thus allowing formation of multiple acoustic transducers on a single substrate.

A cap 16 is positioned above trench 21 to form a global plenum 15 used for multiple acoustic transducers. Alternatively, individual caps and heating elements can be put on each trench and be covered by a secondary global cap. Plenum 15 is filled with fluid having an optical index matching that of core 14.

Heater 18 is used to form a bubble 20. Side heater 17 and side heater 19 are used to keep sidewalls of trench 21 dry. A laser signal 23 traveling through core 14 is either fully reflected by bubble 20, fully transmitted through fluid within trench 21, or partially transmitted and partially reflected by a combination of bubble 20 and fluid within trench 21, depending on the size of bubble 20.

Within the operating range of the transducer, a membrane 24 of bubble 20 is, at least partially, within the area of trench 21 that laser signal 23 enters. Sound waves 22 traveling through cap 16 and fluid within global plenum 15 impinge membrane 24 and deform it. The resulting patterns within membrane 24 are picked up by the portion of laser 23 that transmits through trench 21. The resulting optical signal is detected and sound signals are extracted. The size and shape of trench 21 as well as the temperature and pressure of liquid and vapor within trench 21 are controlled to "tune" the optical signal generated by laser signal 23 traveling through trench 21 so that the resulting extracted sound signals have excellent response within desired sound frequencies. An array of transducer, each with its own customized trench and optical signal, can be used to ensure excellent response over a sound frequency spectrum.

Figure 2:
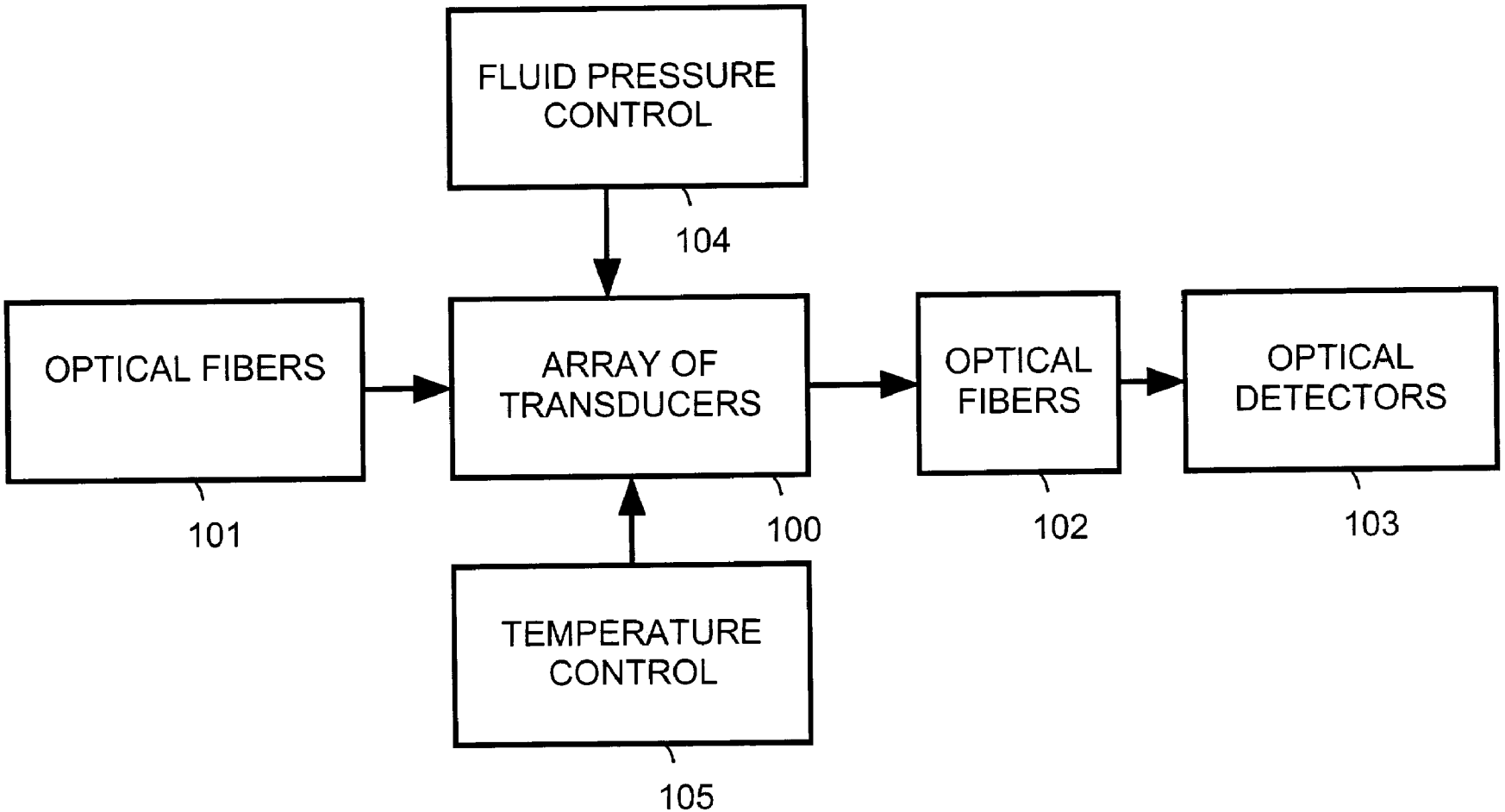
FIG. 2 is a simplified block diagram of circuitry used with an array of transducers in accordance with another preferred embodiment of the present invention.

FIG. 2 is a simplified block diagram of circuitry used with an array of transducers 100. Fluid pressure control 104 controls fluid pressure within one or more global plenums used to store fluid for the array of transducers 100. Temperature control 105 controls power placed through heaters within array of transducers 100. The heaters control the size of bubbles within the transducers.

Optical fibers 101 carry laser signals to array of transducers 100. Optical fibers 102 carry any unreflected light that passes through array of transducers 100. Optical detectors 103 detect light signals carried by optical fibers 102. Any sound signals encoded within the light signals detected by optical detectors 103 are extracted by filters located within optical detectors 103 or in additional electrical circuity.

Figure 3:
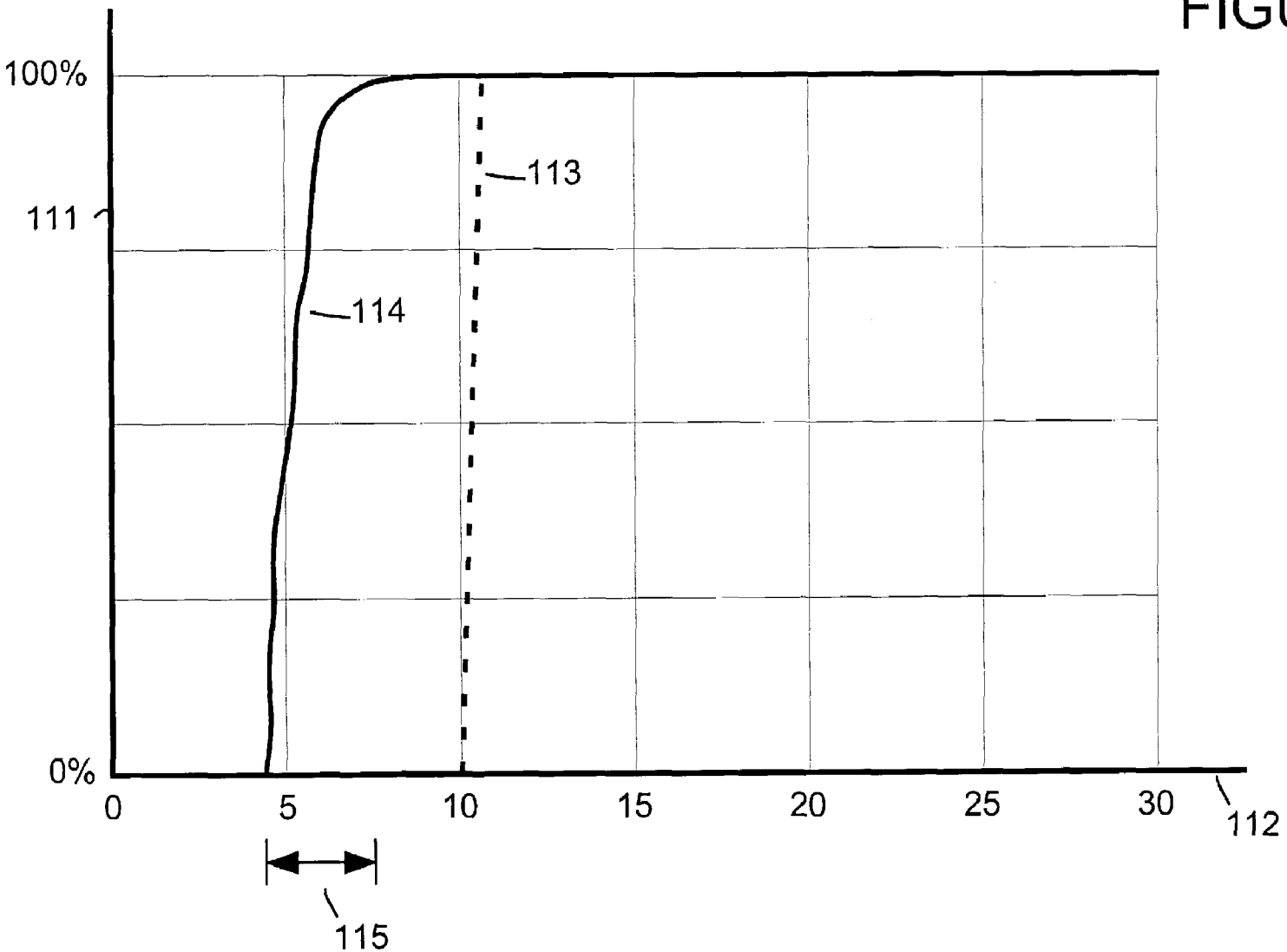
FIG. 3 shows a graph of a reflected optical signal as related to heater power in accordance with a preferred embodiment of the present invention.

FIG. 3 shows a graph of a reflected optical signal as related to heater power. A vertical axis 111 represents the percentage of optical signal 23 (shown in FIG. 1) that is reflected as it travels through trench 21. A horizontal axis 112 represents power through resistor 18. A trace 113 represents power-up response. A trace 114 represents power-down response. An operating range 115 indicates where the percentage of optical signal 23 (shown in FIG. 1) that is reflected as it travels through trench 21 turn on power is between 0% to 100%.

Figure 4:
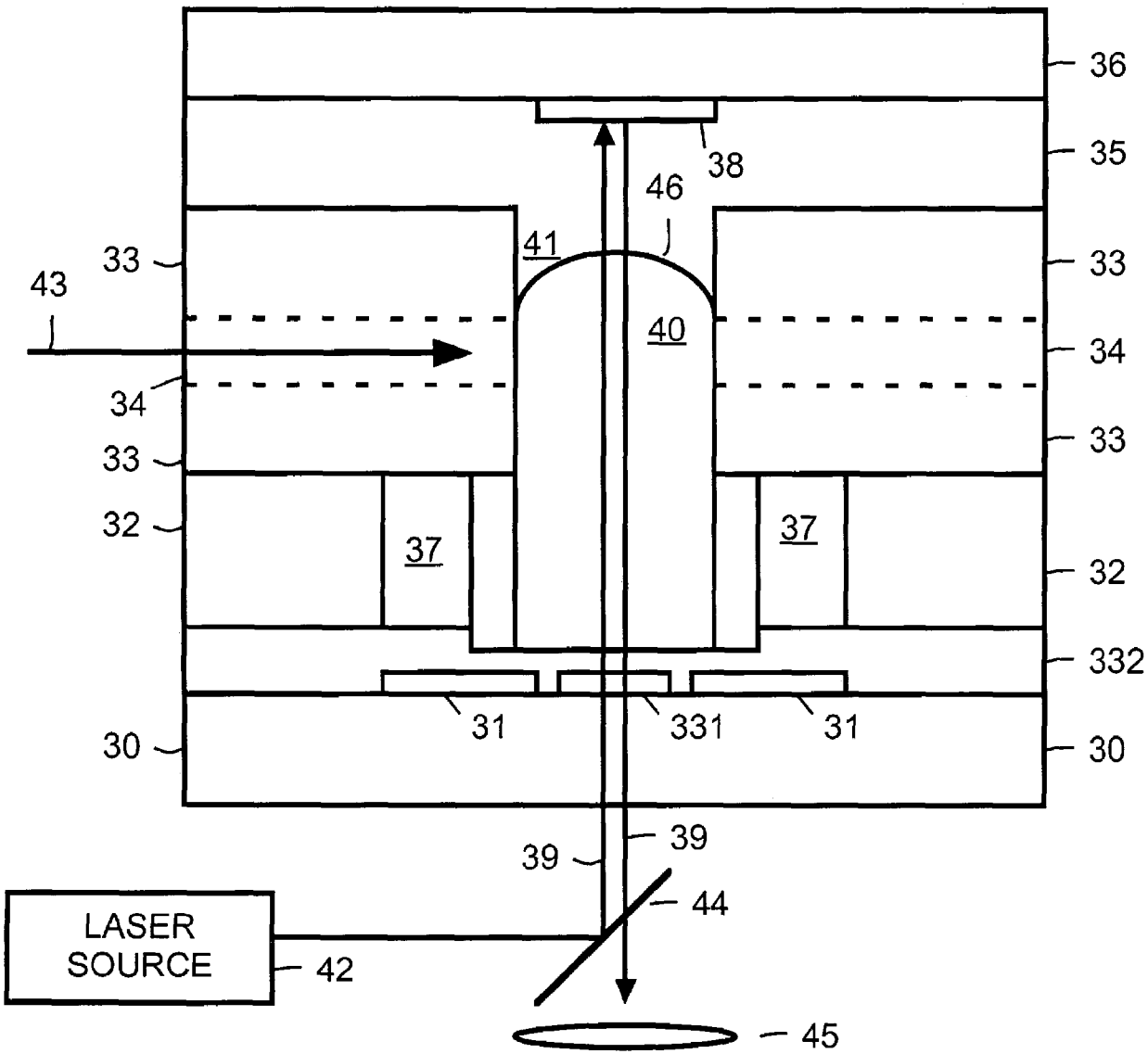
FIG. 4 shows a fluidic acoustic transducer in which bottom up and sidewall detection are used in accordance with another preferred embodiment of the present invention.

FIG. 4 shows a fluidic acoustic transducer in which bottom up and sidewall detection, is used. A substrate 30 is, for example, composed of silicon. Alternatively, substrate 30 is another material such as SiO2, Si3N4, SiC, silicon on sapphire (SOS), silicon on insulator (SOI), silicon on another type of material, quartz, etc. Resistors 31 produce heat. The inner track of each of resistors 31 has no metal covering so that the area between resistors 31 is hot as if there was a third resistor. At least the portion of substrate 30 below a trench 41 needs to be transmissive of infrared (IR) signals. This is done, for example by placing a window within substrate 30 or by using materials such as silicon or quartz that will be very transmissive to IR signals. If needed, an optional central resistor 331 can be formed from an IR transmissive film such as polysilicon, IRSiO2, WSIN, or TaSiN. Over resistors 31 is placed a dielectric coating 332 transmissive to IR, such as Si3N4 or SiO2. Regions 32 are filled with liquid. Pillars 37 are used for side wall heat conduction. Alternatively, a high quality pyrolytic IR transmissive film such as sputtered silicon can be used as a mesa for conduction of heat.

A planar waveguide that includes cladding 33 within which a core 34 runs. The substrates can be bonded by one of several methods that include anodic bonding, fusion bonding, or soldering. Alternatively, spin on or deposited films (fluoropolymers, teos, etc) can be substituted for a bonded layer.

A cap 36 is positioned above trench 41 to form a global plenum 35 for multiple acoustic transducers. Alternatively, individual caps and heating elements can be put on each trench and be covered by a secondary global cap. Plenum 35 is filled with fluid having an optical index matching that of core 34. Resistor 31 and pillars 37 are used to form a bubble 40. Note dielectric coating 332 is thinned or etched below bubble 40 to increase heating there and to force bubble 40 to see the middle hotter than the edges. A laser signal 43 traveling through core 34 is either fully reflected by bubble 40, fully transmitted through fluid within trench 41, or partially transmitted partially reflected by a combination of bubble 40 and fluid within trench 41, depending on the size of bubble 40. For example, cap 36 is composed of Si3N4.

Within the operating range of the transducer, a membrane 46 of bubble 40 is, at least partially, within the area of trench 41 that laser signal 43 enters. Sound waves traveling through cap 36 and fluid within global plenum 35 impinge membrane 46 and deform it. The resulting patterns within membrane 46 are picked up by the portion of laser 43 that transmits through trench 41. The resulting optical signal is detected and sound signals are extracted.

A reflector 38 is located on the bottom of cap 36. For example, reflector 38 is composed of reflective material such as aluminum (Al) or gold (Au). A laser source 42 produces a laser signal 39 that is reflected by a reflecting surface 44, travels through trench 41, is reflected by reflector 38, and is detected by a receiver 45. For example, Laser signal is an IR signal or a Near Infrared Signal (NIR) signal. As laser signal 39 travels across membrane 46, the vibrating patterns within membrane 46 are picked up by laser signal 39 and can be extracted from the optical signal detected by receiver 45.

Provided sound waves are detected and extracted sufficient for a particular application using laser signal 39 and receiver 45, then laser signal 43 and the planar waveguide that includes cladding 33 and core 34 can be omitted.

Laser source 42 and a receiver 45, may be implemented as an external laser source and receiver. Alternatively, laser source 42 and a receiver 45 are replaced by a bonded chip that includes an integrated vertical cavity surface emitting laser (VCSEL) and photodetector.

Figure 5:
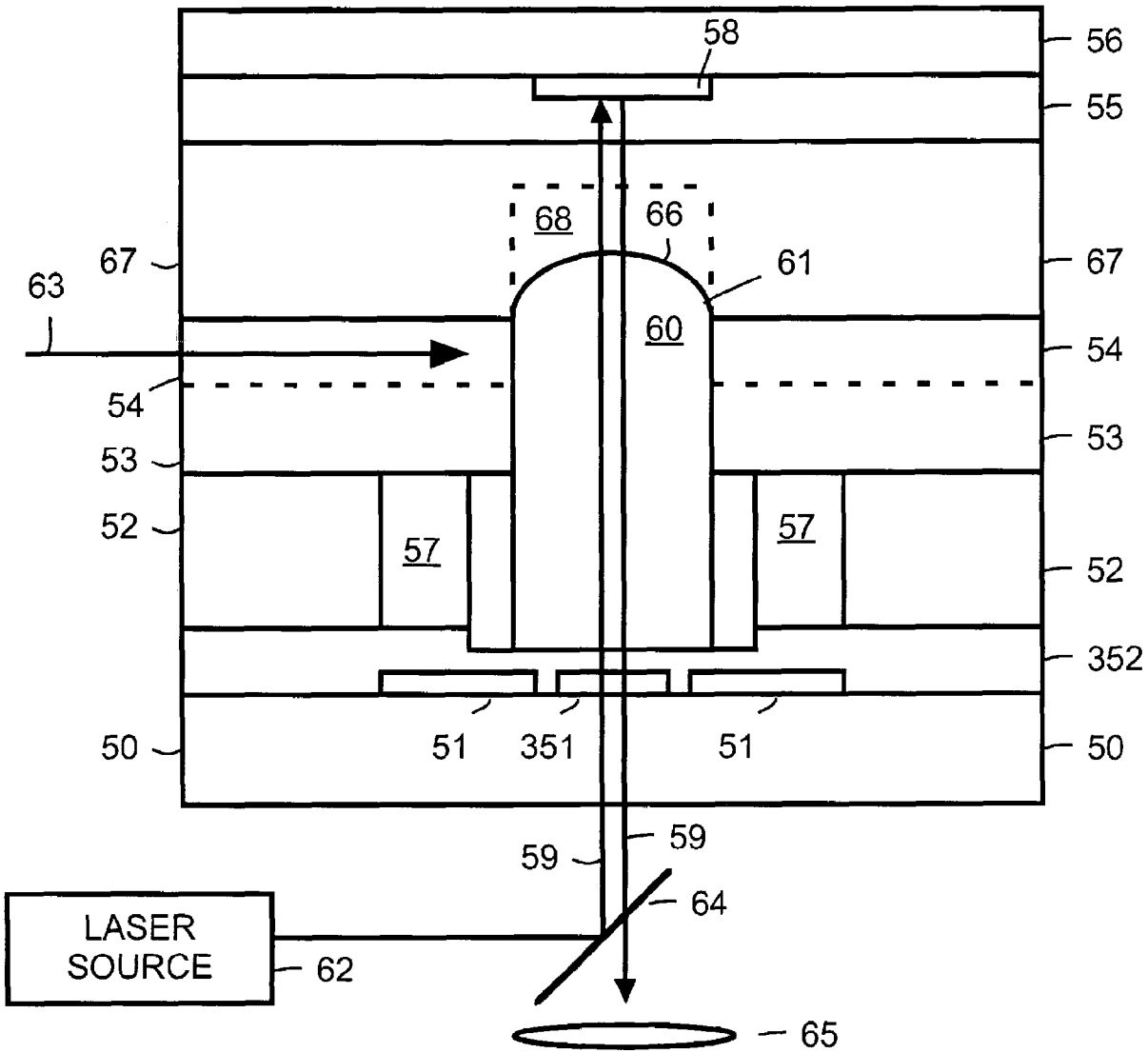
FIG. 5 shows a fluidic acoustic transducer in which bottom up and side wall detection are used in accordance with another preferred embodiment of the present invention.

FIG. 5 shows another embodiment of a fluidic acoustic transducer in which bottom up detection is used. A substrate 50 is, for example, composed of silicon. Alternatively, substrate 50 is another material such as SiO2, Si3N4, SiC, silicon on sapphire (SOS), silicon on insulator (SOI), silicon on another type of material, quartz, etc. Resistors 51 produce heat. The inner track of each of resistors 51 has no metal covering so that the area between resistors 51 is hot as if there was a third resistor. At least the portion of substrate 50 below a trench 61 needs to be transmissive of infrared (IR) signals. This is done, for example by placing a window within substrate 50 or by using materials such as silicon or quartz that are transmissive of IR signals. If needed, an optional central resistor 351 can be formed from an IR transmissive film such as polysilicon, IRSiO2, WSIN, or TaSiN. Over resistors 51 is placed a dielectric coating 352 transmissive to IR, such as Si3N4 or SiO2. Regions 52 are filled with liquid. Pillars 57 are used for side wall heat conduction. Alternatively, a high quality pyrolytic IR transmissive film such as sputtered silicon can be used as a mesa for conduction of heat.

A planar waveguide includes cladding 53 and a core 54. The substrates can be bonded by one of several methods that include anodic bonding, fusion bonding, or soldering, spin on materials, or deposition and planarization.

An IR transmissive layer 67 is placed over core layer 54. For example, IR transmissive layer 67 is composed of quartz. Transmissive layer 67 includes a hollow area 68 extending over trench 61. Fluid having an optical index matching that of core 54 is stored in trench 61 and hollow area 68.

A layer 55, composed of, for example, index matching fluid is positioned above IR transmissive layer 67. An external seal 56 is positioned over layer 55. For example, external seal 56 is composed of Si3N4.

Resistors 51 and pillars 57 are used to form a bubble 60. A laser signal 63 traveling through core 54 is either fully reflected by bubble 60, fully transmitted through fluid within trench 61, or partially transmitted partially reflected by a combination of bubble 60 and fluid within trench 61, depending on the size of bubble 60. Within the operating range of the transducer, a membrane 66 of bubble 60 is, at least partially, within the area of trench 61 that laser signal 63 enters.

A reflector 58 is located on the bottom of external seal 56. For example, reflector 58 is composed of a reflective material stack such as Au and titanium (Ti), Au and Ta, or aluminum (Al). A laser source 62 produces a laser signal 59 that is reflected by a reflecting surface 64, travels through trench 61, is reflected by reflector 58, and is detected by a receiver 65. For example, Laser signal 59 is an IR signal or an NIR signal. As laser signal 59 travels across membrane 66, the vibrating patterns within membrane 66 are picked up by laser signal 59 and can be extracted from the optical signal detected by receiver 65.

Provided sound waves detected and extracted are sufficient for a particular application using laser signal 59 and receiver 65, then laser signal 63 and the planar waveguide that includes cladding 53 and core 54 can be omitted.

Figure 6:
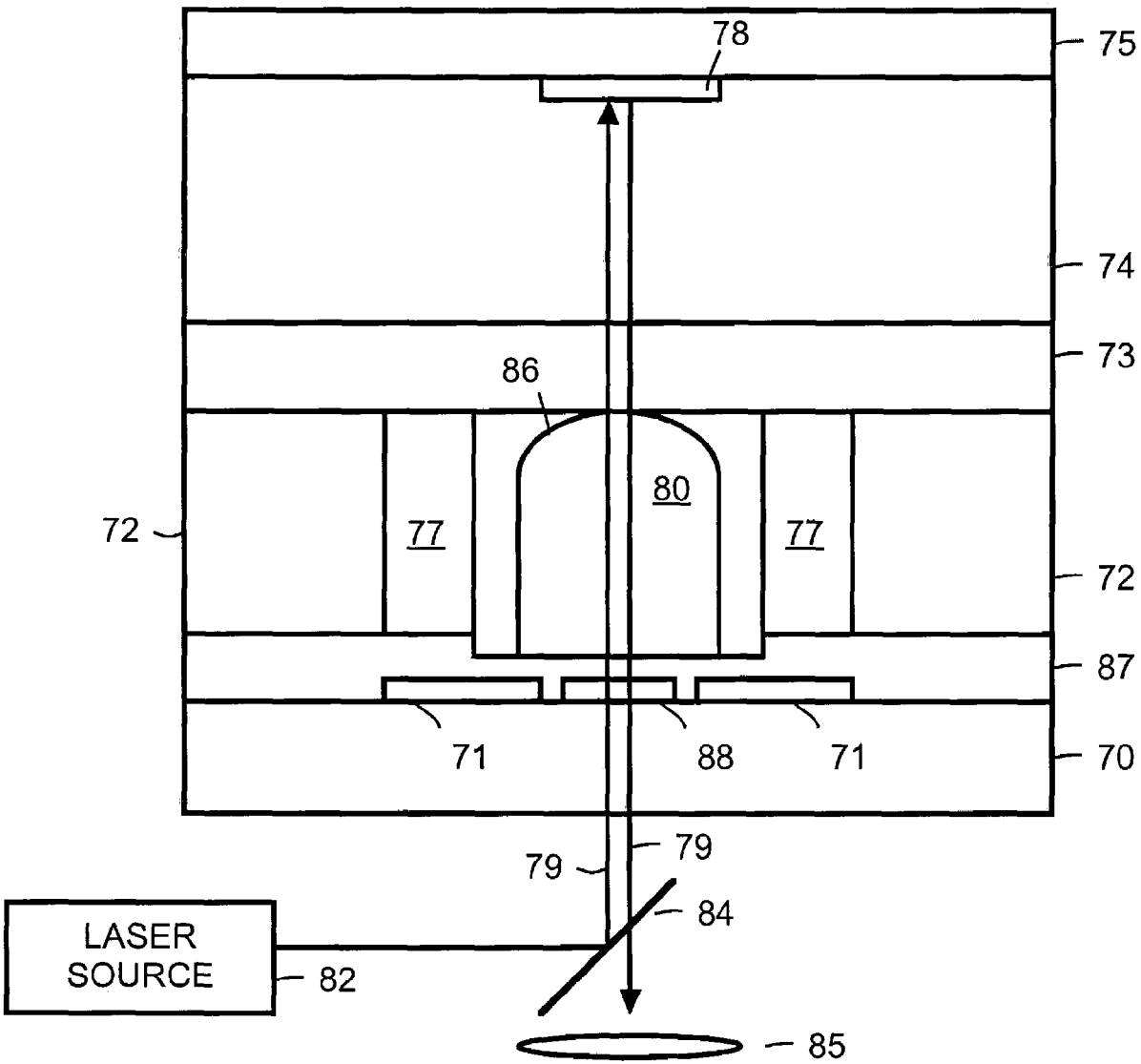
FIG. 6 shows a fluidic acoustic transducer with acoustic amplification in accordance with another preferred embodiment of the present invention.

FIG. 6 shows a fluidic acoustic transducer with acoustic amplification in accordance with another preferred embodiment of the present invention. A substrate 70 is, for example, composed of silicon. Alternatively, substrate 70 is another material such as SiO2, Si3N4, SiC, silicon on sapphire (SOS), silicon on insulator (SOI), silicon on another type of material, quartz, etc. Resistors 71 produce heat. The inner track of each of resistors 71 has no metal covering so that the area between resistors 71 is hot as if there was a third resistor. At least the portion of substrate 70 needs to be transmissive of infrared (IR) signals. This is done, for example by placing a window within substrate 70. If needed, an optional central resistor 88 can be formed from an IR transmissive film such as polysilicon, IRSiO2, WSIN, or TaSiN. Over resistors 71 is placed a dielectric coating 87 transmissive to IR, such as Si3N4 or SiO2. Regions 72 are filled with liquid. Pillars 77 are used for side wall heat conduction. Alternatively, a high quality pyrolytic IR transmissive film such as sputtered silicon can be used as a mesa for conduction of heat.

A layer 74, composed of, for example, index matched fluid, is positioned above glass layer 73. An external seal 75 is positioned over layer 74. For example, external seal 75 is composed of Si3N4.

Resistors 71 and pillars 77 are used to form a bubble 80. A reflector 78 is located on the bottom of external seal 75. For example, reflector 78 is composed of a reflective material stack such as Au and Ti, Au and Ta, or Al. A laser source 82 produces a laser signal 79 that is reflected by a reflecting surface 84, travels through bubble 80, is reflected by reflector 78, and is detected by a receiver 85. For example, laser signal 79 is an IR signal or an NIR signal. As laser signal 79 travels across membrane 86, the vibrating patterns within membrane 86 are picked up by laser signal 79 and can be extracted from the optical signal detected by receiver 85.

Figure 7:
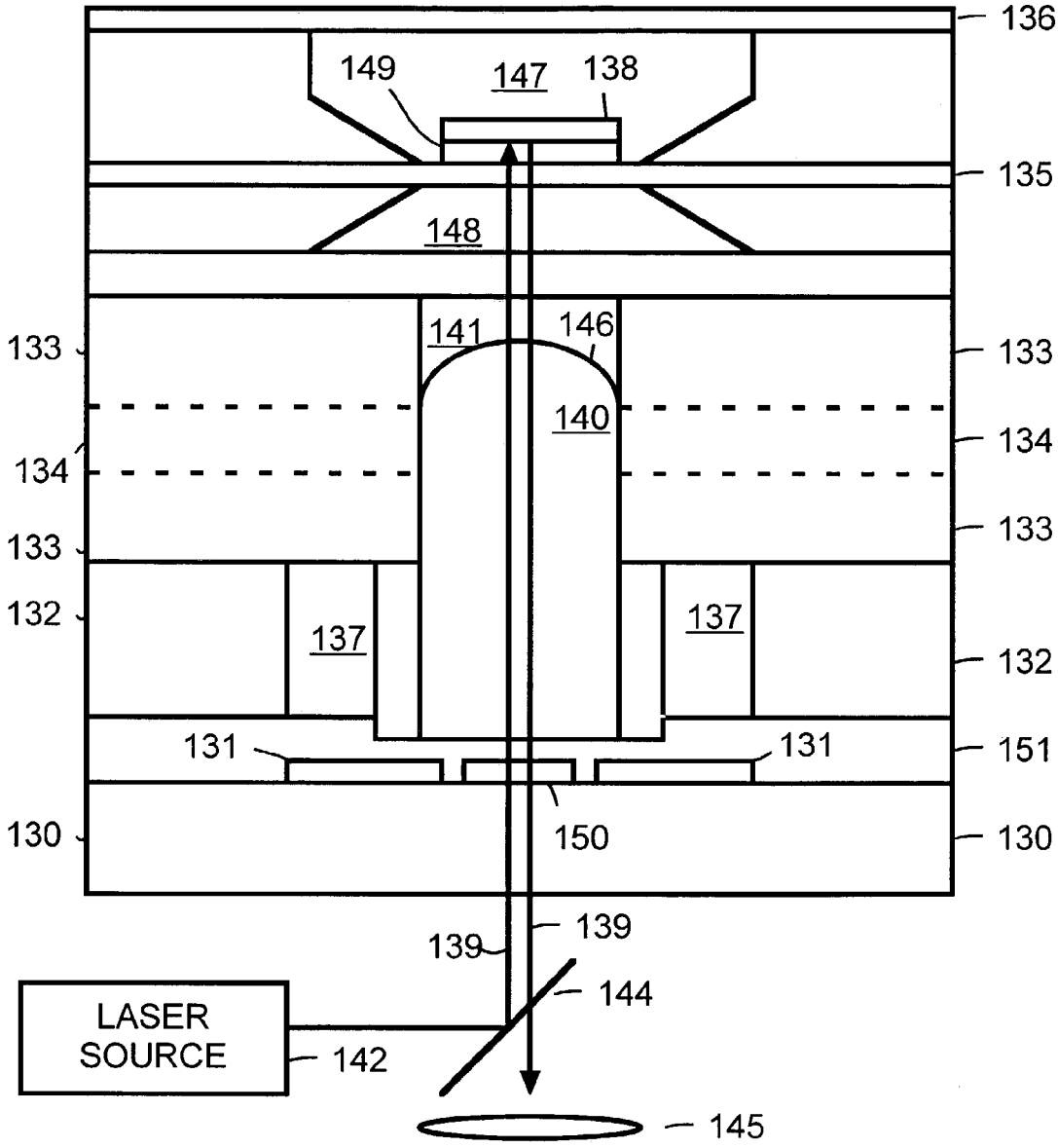
FIG. 7 shows a fluidic acoustic transducer with acoustic amplification in accordance with another preferred embodiment of the present invention.

FIG. 7 shows a fluidic acoustic transducer with acoustic amplification and differential electrical comparison. A substrate 130 is, for example, composed of silicon. Alternatively, substrate 130 is another material such as SiO2, Si3N4, SiC, silicon on sapphire (SOS), silicon on insulator (SOI), silicon on another type of material, quartz, etc. Resistors 131 produce heat. The inner track of each of resistors 131 has no metal covering so that the area between resistors 131 is hot as if there was a third resistor. At least the portion of substrate 130 below a trench 141 needs to be transmissive of infrared (IR) signals. This is done, for example by placing a window within substrate 130. If needed, an optional central resistor 150 can be made from an IR transmissive film such as polysilicon, IRSiO2, WSIN, or TaSiN. Over resistors 131 is placed a dielectric coating 151 transmissive to IR, such as Si3N4 or SiO2. Regions 132 are filled with liquid. Pillars 137 are used for side wall heat conduction. Alternatively, a high quality pyrolytic IR transmissive film such as sputtered silicon can be used as a mesa for conduction of heat. A planar waveguide that includes cladding 133 within which a core 134 runs. The substrates can be bonded by one of several methods that include anodic bonding, fusion bonding, soldering, spin on polymers (fluoropolymers or Teos based) or deposited and planarized materials.

A chamber 148 and a chamber 147 are formed, for example, from two bonded Silicon or SiC wafers. Chamber 148 and chamber 147 are filled with liquid such as cyclohexane, 2-fluorotuolene, or benzene. A boundary layer 135 and a boundary layer 136 are composed of, for example, of a 5000 Angstrom thick layer of Si3N4. A section 149 is composed of, for example, boron doped silicon or polysilicon, or a piezoelectric ZnO transducer. An IR reflective region 138 is composed of, for example, Al or Au. Chamber 148 functions as a resonance chamber.

Resistors 131 and pillars 137 are used to form a bubble 140. A laser source 142 produces a laser signal 139 that is reflected by a reflecting surface 144, travels through trench 141, is reflected by reflective region 138, and is detected by a receiver 145. For example, Laser signal is an IR signal or an NIR signal. As laser signal 139 travels across membrane 146, the vibrating patterns within membrane 146 are picked up by laser signal 139 and can be extracted from the optical signal detected by receiver 145.

Figure 8:
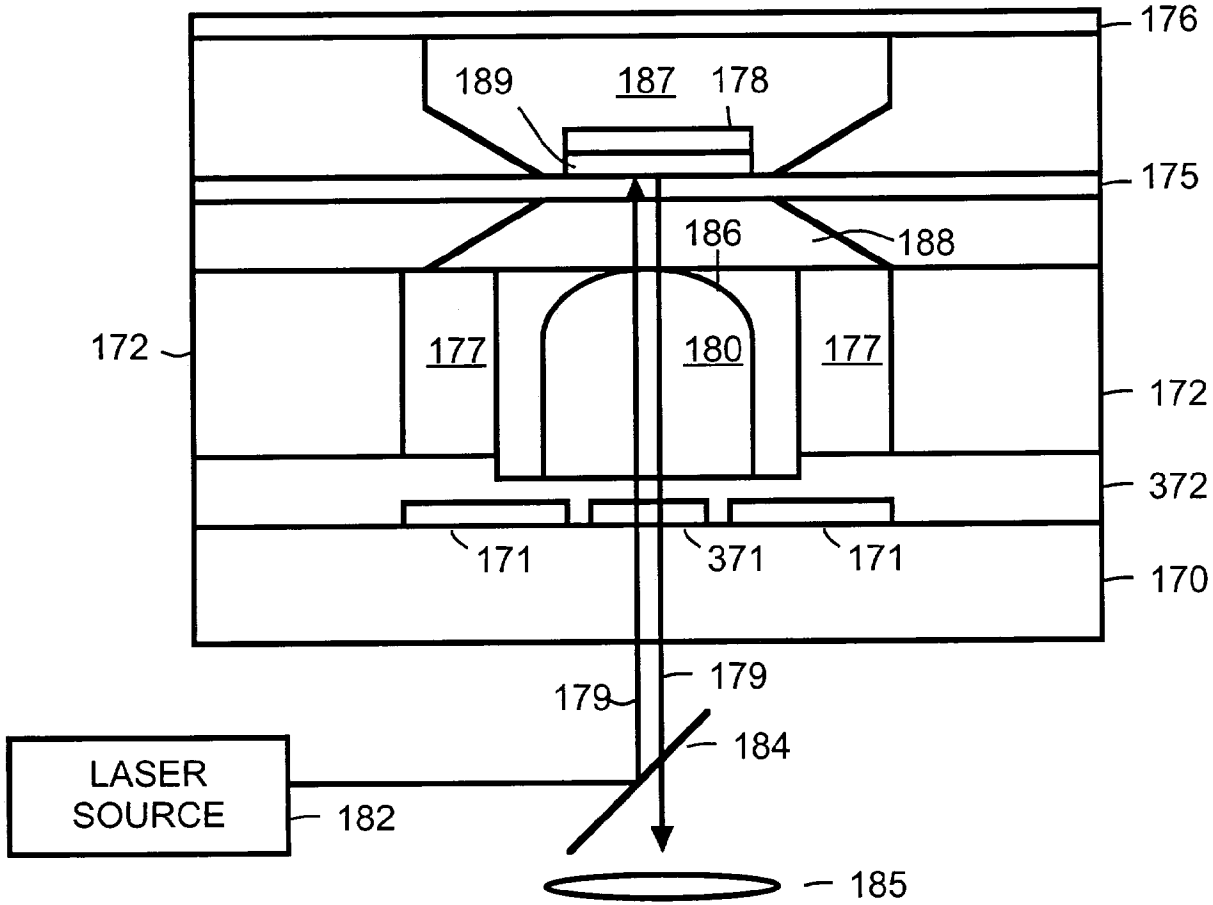
FIG. 8 shows a fluidic acoustic transducer with acoustic amplification in accordance with another preferred embodiment of the present invention.

FIG. 8 shows a fluidic acoustic transducer with acoustic amplification and differential electrical comparison. A substrate 170 is, for example, composed of silicon. Alternatively, substrate 170 is another material such as SiO2, Si3N4, SiC, silicon on sapphire (SOS), silicon on insulator (SOI), silicon on another type of material, quartz, etc. Resistors 171 produce heat. The inner track of each of resistors 171 has no metal covering so that the area between resistors 171 is hot as if there was a third resistor. At least the portion of substrate 170 needs to be transmissive of infrared (IR) signals. This is done, for example by placing a window within substrate 170. If needed, an optional central resistor 371 can be made from an IR transmissive film such as polysilicon, IRSiO2, WSIN, or TaSiN. Over resistors 171 is placed a dielectric coating 372 transmissive to IR, such as Si3N4 or SiO2. Regions 172 are filled with liquid. Pillars 177 are used for side wall heat conduction. Alternatively, a high quality pyrolytic IR transmissive film such as sputtered silicon can be used as a mesa for conduction of heat.

A chamber 188 and a chamber 187 are formed, for example, from two bonded Silicon or SiC wafers. Chamber 188 and chamber 187 are filled with liquid such as cyclohexane, 2-fluorotuolene, or benzene. A boundary layer 175 and a boundary layer 176 are composed of, for example, of a 5000 Angstrom thick layer of Si3N4. A section 189 is composed of, for example, boron doped silicon or polysilicon, or a piezo ZnO transducer. An IR reflective region 178 is composed of, for example, Al or Au. Chamber 188 functions as a resonance chamber.

Resistors 171 and pillars 177 are used to form a bubble 180. A laser source 182 produces a laser signal 179 that is reflected by a reflecting surface 184, travels through bubble 180, is reflected by reflection region 178, and is detected by a receiver 185. For example, laser signal 179 is an IR signal or an NIR signal. As laser signal 179 travels across membrane 186, the vibrating patterns within membrane 186 are picked up by laser signal 179 and can be extracted from the optical signal detected by receiver 185.

Figure 9:
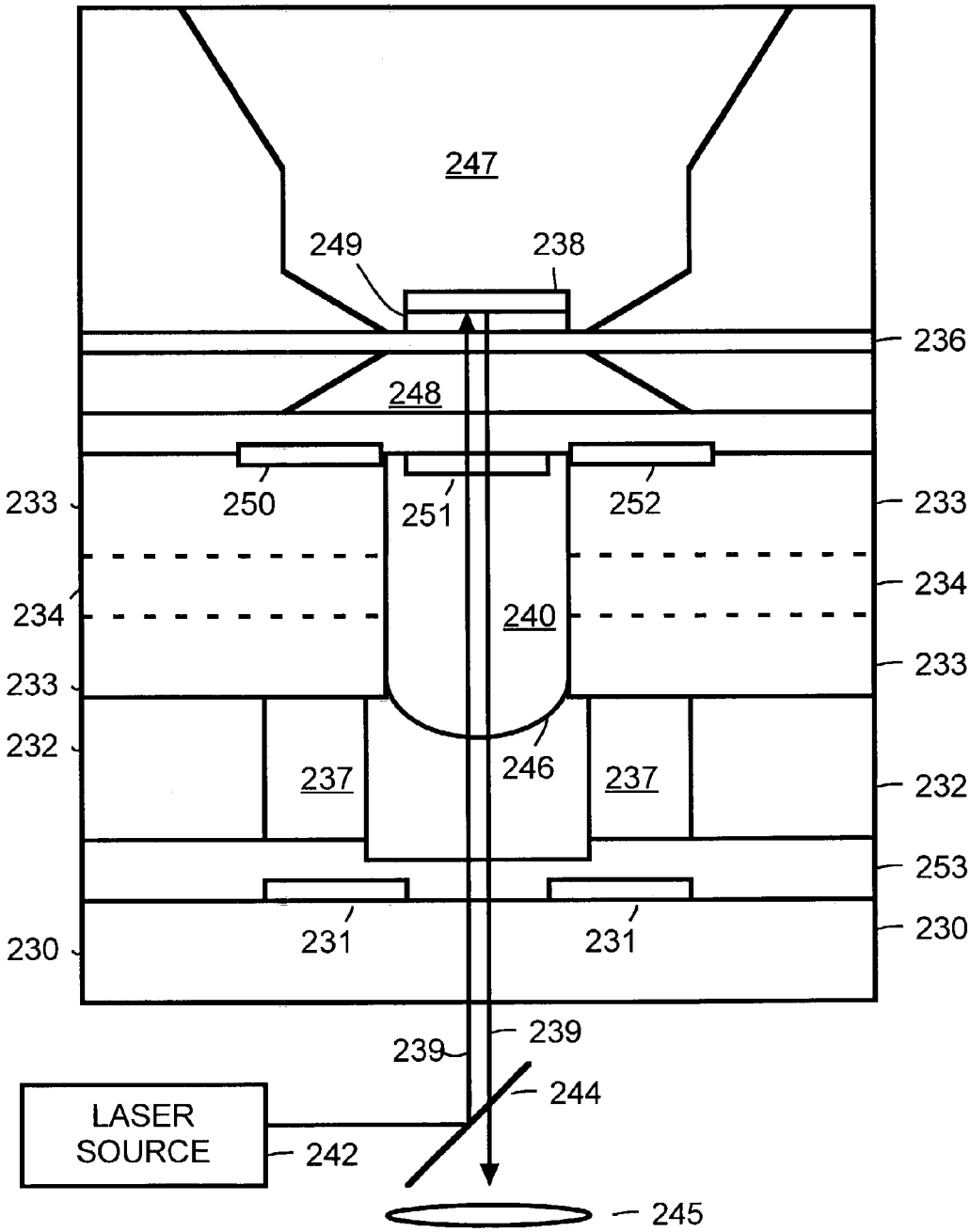
FIG. 9 shows a fluidic acoustic transducer with acoustic amplification in accordance with another preferred embodiment of the present invention.

FIG. 9 shows a fluidic acoustic transducer with acoustic amplification and differential electrical comparison. A substrate 230 is, for example, composed of silicon. Alternatively, substrate 230 is another material such as SiO2, Si3N4, SiC, silicon on sapphire (SOS), silicon on insulator (SOI), silicon on another type of material, quartz, etc. At least the portion of substrate 230 needs to be transmissive of infrared (IR) signals. This is done, for example by placing a window within substrate 230. Regions 232 are filled with liquid. A planar waveguide that includes cladding 233 within which a core 234 runs. The substrates can be bonded by one of several methods that include anodic bonding, fusion bonding, soldering, spin on polymers (fluoropolymers or Teos based) or deposited and planarized materials.

A chamber 248 and a chamber 247 are formed, for example, from two bonded Silicon or SiC wafers. Chamber 248 is filled with liquid such as cyclohexane, 2-fluorotuolene, or benzene. Chamber 247 is filled, for example, with an acoustic gel packed for matching density of chamber 248. Alternatively, chamber 247 is open and exposed to the surrounding environment. A boundary layer 236 is composed of, for example, of a 5000 Angstrom thick layer of Si3N4. A section 249 is composed of, for example, boron doped silicon or polysilicon, or a piezo ZnO transducer. An IR reflective region 238 is composed of, for example, Al or Au. Chamber 248 functions as a resonance chamber.

A heater 250, a heater 251 and a heater 252 are used to form a bubble 240. Optional heaters 231, dielectric coating 253 and optional pillars 237 can be used to provide sidewall heat and heat conduction. A laser source 242 produces a laser signal 239 that is reflected by a reflecting surface 244, travels through bubble 240, is reflected by reflective region 238, and is detected by a receiver 245. For example, Laser signal is an IR signal or an NIR signal. As laser signal 239 travels across membrane 246, the vibrating patterns within membrane 246 are picked up by laser signal 239 and can be extracted from the optical signal detected by receiver 245.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

I claim:

1. A transducer system comprising:

a trench filled with liquid;

a heater used to create a bubble in the liquid within the trench;

a laser source that generates first light signals that pass through a portion of a substrate in vertical alignment with the trench before passing through a membrane of the bubble, sound signals causing deformations within the membrane of the bubble; and, an optical detector that detects the first light signals after the first light signals have passed through the subtrate, the trench, and the membrane after having been reflected back through the membrane, the trench and through the substrate, the sound signals being reconstructed from the first light signals detected by the optical detector.

2. A transducer system as in claim 1 wherein second light signals are transmitted through sidewalls of the trench.

3. A transducer system as in claim 1 wherein the first light signals are transmitted through a bottom of the trench.

4. A transducer system as in claim 1 wherein the heater includes a heater array located below the trench.

5. A transducer system as in claim 1 wherein the heater includes pillars located on sides of the trench.

6. A transducer system as in claim 1 wherein the heater includes a heater array located above the trench.

7. A transducer system as in claim 1 wherein the first light signals are composed of one of the following:

infrared light;

near infrared light.

8. A transducer system as in claim 1 additionally comprising:

wherein the heater includes a resonance chamber through which the sound signals pass before reaching the membrane.

9. An array of transducers, each transducer comprising:

a trench filled with liquid;

a heater used to create a bubble in the liquid within the trench;

a laser source that generates first light signals that pass through a portion of a substrate in vertical alignment with the trench before passing through a membrane of the bubble, sound signals causing deformations within the membrane of the bubble; and, an optical detector that detects the first light signals after the first light signals have passed through the substrate, the membrane and after having been reflected back through the membrane and through the substrate, the sound signals being reconstructed from the first light signals detected by the optical detector.

10. An array of transducers as in claim 9 wherein second light signals are transmitted through sidewalls of the trench.

11. An array of transducers as in claim 9 further comprising:

an acoustic resonance chamber in vertical alignment with the trench.

12. An array of transducers as in claim 9 wherein the first light signals are transmitted through a bottom of the trench.

13. An array of transducers as in claim 9 wherein the heater includes a heater array located below the trench.

14. An array of transducers as in claim 9 wherein the heater includes pillars located on sides of the trench.

15. An array of transducers as in claim 9 wherein the heater includes a heater array located above the trench.

16. An array of transducers as in claim 9 wherein the first light signals are composed of one of the following:

infrared light;

near infrared light.

17. An array of transducers as in claim 9 additionally comprising: wherein the heater includes a resonance chamber through which the sound signals pass before reaching the membrane.

18. A method for detecting sound signals comprising:

generating first light signals that pass through a membrane of a bubble within a trench, the sound signals causing deformations within the membrane of the bubble;

reflecting the first light signals afier the first light signals have passed through the membrane and a substrate;

detecting the first light signals afier the first light signals have passed through the substrate and the membrane prior to the reflecting; and, reconstructing the sound signals from the first light signals detected by the optical detector.

19. A method as in claim 18 wherein second light signals are transmitted through sidewalls of the trench.

20. A method as in claim 18 wherein the first light signals are transmitted through a bottom of the trench.

* * * * *

UNITED STATES PATENT AND TRADEMARK OFFICE

CERTIFICATE OF CORRECTION

PATENT NO. : 7,359,523 B2
APPLICATION NO. : 10/462988
DATED : April 15, 2008
INVENTOR(S) : Tyler Sims It is certified that error appears in the above-identified patent and that said Letters Patent is hereby corrected as shown below:

Column 8, Line 46, (Approx.), Claim 18, delete "afier" and insert -- after --;

Column 8, Line 48, (Approx.), Claim 18, delete "afier" and insert -- after --.

Signed and Sealed this

Ninth Day of November, 2010

David J. Kappos

David J. Kappos
*Director of the United States Patent and Trademark Office*